US007258367B2

(12) United States Patent
Legrand

(10) Patent No.: US 7,258,367 B2
(45) Date of Patent: Aug. 21, 2007

(54) LOOSELY BOUND BOOK WITH FOAM-BASED PAGES

(76) Inventor: Christian Legrand, 100/203 M. Chollada Soi 23/4, Ampur Bangbuathong, 11.110 Nonthaburi (TH)

( * ) Notice: Subject to any disclaimer, the term of this patent is extended or adjusted under 35 U.S.C. 154(b) by 49 days.

(21) Appl. No.: 11/256,745

(22) Filed: Oct. 24, 2005

(65) Prior Publication Data

US 2007/0090639 A1 Apr. 26, 2007

(51) Int. Cl.
*B42D 1/00* (2006.01)
*B42D 5/00* (2006.01)

(52) U.S. Cl. ..... 281/15.1; 281/21.1; 281/38

(58) Field of Classification Search ..... 281/21.1, 281/15.1, 51, 38; 402/8, 9, 13, 57; 434/309, 434/317, 159; 446/147, 155; 283/115; 40/530, 40/726

See application file for complete search history.

(56) References Cited

U.S. PATENT DOCUMENTS 4,280,241 A * 7/1981 Pfaff ..... 412/3
5,620,206 A * 4/1997 Flores ..... 281/21.1
6,837,521 B2 * 1/2005 Legrand ..... 281/21.1

* cited by examiner

*Primary Examiner*—Willmon Fridie, Jr.
(74) *Attorney, Agent, or Firm*—Adam H. Jacobs

(57) ABSTRACT

A loosely bound book of foam-based pages includes a plurality of pages, each page including a middle foam plate and front and back semi-rigid paper plates mounted on and sandwiching the middle foam plate and at least one binder slot formed in each of the pages, the binder slot extending entirely through the middle foam plate and the paper plates. At least one binding strap is extendable through the binder slot of each of the pages for binding the plurality of pages in a book and at least one releasable binding strap closure device is mounted on the binding strap, the releasable binding strap closure device operative to open and close the binding strap to permit pages to be added to and removed from the loosely bound book.

7 Claims, 2 Drawing Sheets

LOOSELY BOUND BOOK WITH FOAM-BASED PAGES

BACKGROUND OF THE INVENTION

1. Technical Field

The present invention is directed to looseleaf books and, more particularly, to a loosely bound book of foam-based pages which includes a plurality of pages, each page including a middle foam plate and front and back semi-rigid paper plates mounted on and sandwiching the middle foam plate, at least one binder slot formed in each of the pages which extends completely through the page, at least one binding strap extendable through the binder slots of each of the pages and at least one releasable binding strap closure device mounted on the binding strap to permit opening and closing of the binding strap for adding or removing pages from the loosely bound book.

2. Description of the Prior Art

There are many different kinds of books and book bindings which are currently used in the publishing industry. While the majority of books are constructed of paper and paper products, there are many different types of children's books which are constructed of different materials such as cloth, foam, or other such materials, in order to provide additional tactile sensations for the children reading the books. Recently, one of the more popular types of manufacturing materials used in connection with children's books are thin plates of foam which constitute the pages and front and rear covers of the children's books. These are bound together in many different ways and assembled to form many different shapes and sizes of children's books, but one of the inherent problems encountered in the use of such foam pages is that the foam material which is used to construct the pages is not conducive for writing thereon, only for printing by the manufacturer, and thus the children who are using the foam books cannot personalize the foam book by writing their own thoughts and ideas on the pages of the foam book. There is therefore a need to provide a book which incorporates pages which permit the children to write on those pages, yet which also incorporates many of the advantages supplied by use of foam-based materials for construction thereof.

Another disadvantage found in connection with children's books currently being manufactured is that the binding methods used in connection with those children's books render it highly inconvenient or even impossible to add or subtract pages from the children's book, thus severely limiting the ability of the child to personalize the book and add or subtract pages therefrom. While various binding methods are used in connection with paper-based pages which permit the addition and subtraction of pages from the book, such a binding has heretofore been unavailable for use with foam-based pages, and the main reason for this has been that addition and subtraction of pages from the foam-based page book has been generally deemed unnecessary. Once the child has the ability to modify or personalize the pages of the book, however, the ability to add and remove pages from the book becomes far more critical, and therefore there is a need for a binding device which will permit the addition and subtraction of pages from a foam-based book and do so in an easy to use and aesthetically attractive configuration.

Therefore, it is an object of the present invention to provide a loosely bound book of foam-based pages which includes a binding device which permits addition and subtraction of pages therefrom.

Another object of the present invention is to provide a loosely bound book of foam-based pages in which the plurality of pages are constructed of a middle foam plate sandwiched between front and back paper plates which permit the user to write thereon, yet which also provide the soft edges of the foam page which is desirable.

Another object of the present invention is to provide a loosely bound book of foam-based pages which includes a releasable strap which extends through binder slots formed in each of the pages to bind the loosely bound pages to one another in a loosely bound book format.

Another object of the present invention is to provide a loosely bound book of foam-based pages in which the binder strap includes a releasable closure device such as a hook and loop fastener attached at opposite ends of the strap to close the binder strap in a loop configuration to secure the loosely bound pages in a loosely bound book format and also permit opening of the binder strap to add or subtract pages from the book.

Finally, an object of the present invention is to provide a loosely bound book of foam-based pages which is relatively simple in design and is safe, efficient, and effective in use.

SUMMARY OF THE INVENTION

The present invention provides a loosely bound book of foam-based pages which includes a plurality of pages, each page including a middle foam plate and front and back semi-rigid paper plates mounted on and sandwiching the middle foam plate and at least one binder slot formed in each of the plurality of pages, the binder slot extending through the middle foam plate and the front and back semi-rigid paper plates. At least one binding strap is extendable through the binder slot of each of the pages for binding the plurality of pages in a book and at least one releasable binding strap closure device is mounted on the binding strap, the releasable binding strap closure device operative to open and close the binding strap to permit pages to be added to and removed from the loosely bound book.

The present invention thus provides a substantial improvement over those books currently being manufactured and sold for use by children. For example, because the foam-based pages include a middle foam plate and front and back paper-based plates, the child may write on the page while not having to be concerned about cutting his or her fingers on the edges of the page, due to the middle foam plate extending beyond the edges of the paper plates. Furthermore, because the binder strap may be quickly and easily opened and closed, the user of the present invention may easily add or subtract pages from the loosely bound book, thus personalizing the book and making its use far more enjoyable and effective. Finally, because the size of the book is only limited by the length of the binder strap, artificial limits on the imagination and ingenuity of the child using the book of the present invention are substantially eliminated, thus rendering the book of the present invention far superior to those size-restricted books found in the prior art. It is therefore seen that the loosely bound book of foam-based pages of the present invention provides a substantial improvement over those devices found in the prior art.

DESCRIPTION OF THE PREFERRED EMBODIMENT

Figure 1:
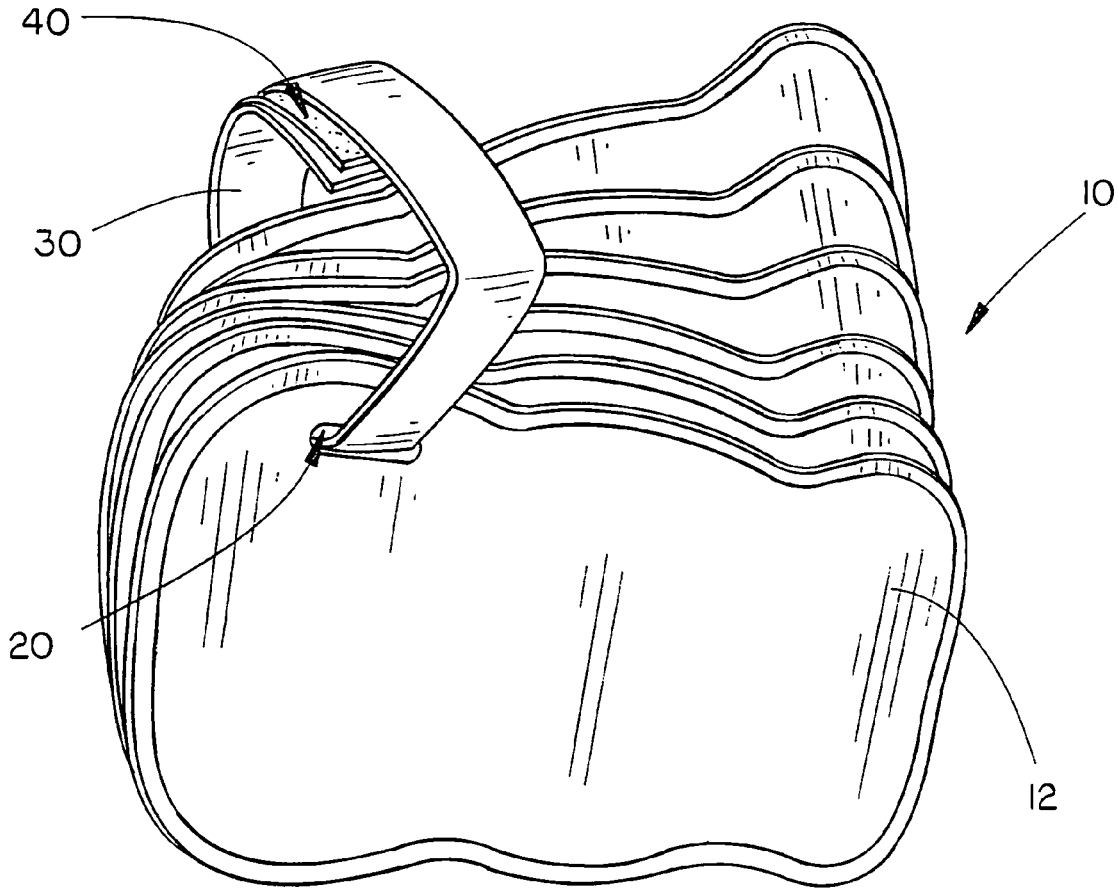
FIG. 1 is a perspective view of the loosely bound book of the present invention.
Figure 2:
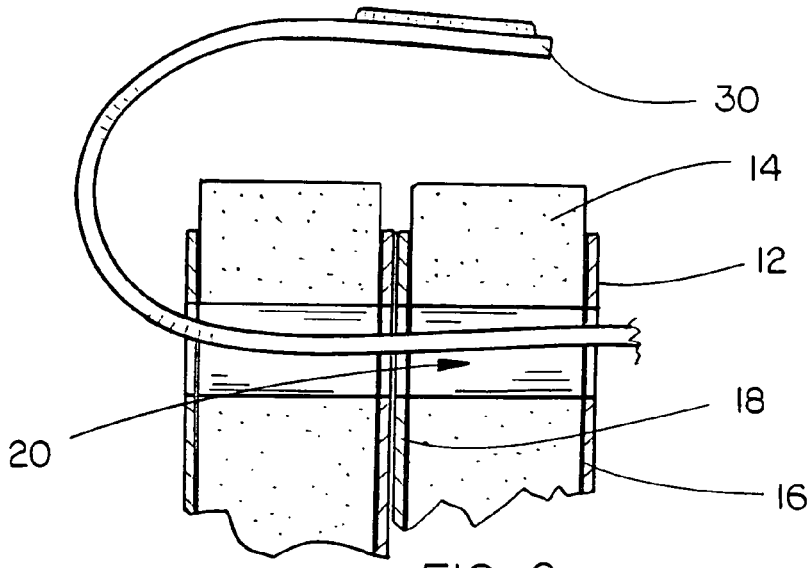
FIG. 2 is a detailed side elevational view of the pages and binding strap of the present invention showing the crosssectional construction of the pages and how the binder strap secures the pages in a loosely bound book format.
Figure 3:
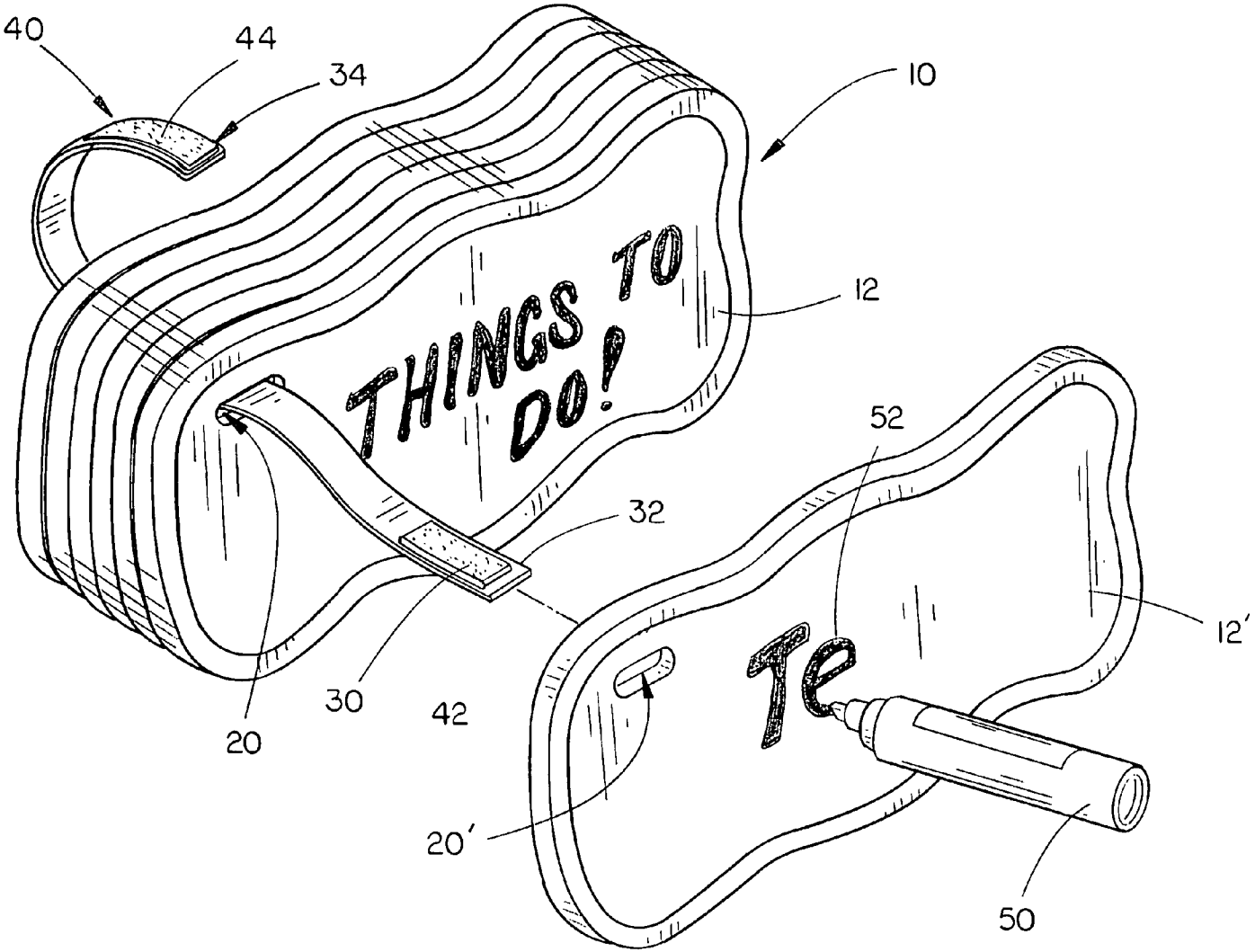
FIG. 3 is a perspective view of the loosely bound book of the present invention showing how easy it is to add pages to the book and what a simple matter it is to write on the pages of the book thereby allowing the user to personalize the book.

The loosely bound book 10 of the present invention is shown best in FIGS. 1-3 as including a plurality of foam-based pages 12, each of which would be constructed in substantially the same manner. Specifically, each of the foam-based pages 12 would include a middle foam plate 14 and front and back semi-rigid paper plates 16 and 18, the front and back paper plates 16 and 18 secured to the middle foam plate 14 by an adhesive material or the like to ensure that the front and back paper plates 16 and 18 remain attached to the middle foam plate 14. In the preferred embodiment the middle foam plate 14 would preferably be constructed of a foam material, specifically the foam marketed under the common name "Eva Foam," which is a polymer foam made of ethyl-vinyl acetate and which is non-toxic and resilient to tearing, and thus is quite safe for use with children. However, one of the disadvantages of Eva Foam is that it is pliable and thus is not well-suited for writing thereon as it bends easily, in addition to the fact that the foam material does not readily permit writing thereon due to the characteristics of the surface of the foam material. Instead, Eva Foam material is well suited for printing on the pages by the manufacturer, hence its use in connection with many different types of children's books. For use in the present invention, however, it is necessary to combine the foam plate with material more conducive for writing thereon, and it is for this reason that the front and back paper plates 16 and 18 are mounted on the middle foam plate 14.

In the preferred embodiment, the front and back paper plates 16 and 18 would be constructed of a semi-rigid paper material such as cardstock or the like which would readily take ink, crayon, pencil, or the markings of virtually any type of writing implement thereon, and will also provide additional rigidity for the middle foam plate 14. Furthermore, it is important that the front and back paper plates 16 and 18 have dimensions slightly smaller than the middle foam plate 14 such that the middle foam plate 14 extends beyond the edges of the front and back paper plates 16 and 18, as shown best in FIGS. 1 and 2, thus ensuring that the edges of the pages 12 are foam, thus preventing paper cuts or other injuries to children using the present invention. A final important consideration for the pages 12 is that they may be constructed of virtually any size, shape, and thickness via die cut or other cutting method, which adds to the whimsical yet useful nature of the loosely bound book 10 of the present invention. Therefore, the free-form shape shown in FIGS. 1 and 3 should be understood to be only illustrative of the types of shapes available for use with the present invention, which are only limited by the economic, manufacturing, and purchasing restrictions set by the manufacturer and the marketplace.

As shown best in FIGS. 1 and 2, each of the pages 12 would have a binder slot 20 formed in the page extending through the front paper plate 16, middle foam plate 14, and back paper plate 18, the binder slot 20 preferably being generally rectangular or rounded rectangular in shape and having a dimension of approximately one quarter to three quarters of an inch in width and one eighth to one quarter of an inch in height. In the preferred embodiment, each binder slot 20 in each of the pages 12 would be formed in approximately the same location on each of the pages 12 so that the pages 12 are generally aligned with one another when the binder slots 20 are in alignment, although it is not necessary that the binder slots 20 be aligned with one another to permit the loosely bound book 10 of the present invention to function as intended.

For releasably securing the pages 12 in the loosely bound book 10, a binding strap 30 would be provided, which, in the preferred embodiment, would be a fabric strap having a width of approximately one-half inch and a length of approximately one to four inches, depending on the size of the loosely bound book 10 and the thickness of the pages 12. Of course, it should be noted that other variations of the binding strap 30 could include a plastic ring, string, a cord or any other binding strap device which will function in the same manner to releasably secure the pages to one another. The binding strap 30 would further include a binding strap closure device 40 which, in the preferred embodiment, would be a hook and loop fastener with one side of the material, namely the hook side 42, mounted on one end 32 of binding strap 30, and the loop section 44 of binding strap closure device 40 being mounted on the opposite end 34 of binding strap 30 so that when the hook section 42 of binding strap closure device 40 is connected to the loop section 44 of binding strap closure device 40, the one end 32 and opposite end 34 of binding strap 30 are releasably connected to one another, thus closing the binding strap 30 in a loop configuration. Of course, the specific type of binding strap closure device 40 used in connection with the present invention is not critical so long as the intended function of permitting release and connection of the one end 32 and opposite end 34 of binding strap 30 is maintained.

To releasably secure the pages 12 in the loosely bound book 10 of the present invention, the binding strap 30 would be extended through the binder slot 20 of each of the pages 12, as shown best in FIGS. 1 and 2, and the binding strap closure device 40 would be secured to fasten the binding strap 30 in the loop configuration shown in FIG. 1 to bind the pages 12 together. As shown in FIG. 3, should the user of the present invention decide to add another page 12' to the loosely bound book 10, he or she would merely disengage the binding strap closure device 40 to open binding strap 30 and then add the additional page by sliding the binding strap 30 through the binder slot 20' of the new page and then would reconnect the binding strap closure device 40 to close the binding strap 30, thus reforming the loop configuration of binding strap 30 and closing the loosely bound book 10 of the present invention. By following the same general operation, the user may either add or subtract pages 12 from the loosely bound book 10, a feature not provided by those foam-based books found in the prior art.

FIG. 3 also illustrates an important feature of the loosely bound book 10 of the present invention in that each of the pages 12 are designed to be written on by the user of the loosely bound book 10 of the present invention. For example, the user may take a writing instrument such as a pen 50 and write any selected indicia 52 on the page 12, according to the intentions of the user. Virtually any type of design, lettering, or other writing may be added to the pages 12 of the present invention, a feature not found in those books found in the prior art. Furthermore, because the pages 12 of the loosely bound book 10 may be quickly and easily added and/or removed from the loosely bound book 10, a user of the present invention may freely write on any of the pages and, if the resulting writing or design does not conform to their intended writing or design, the offending page may be quickly and easily removed from the loosely bound book 10. Thus it is a very simple matter to add or subtract pages from the loosely bound book 10 of the present invention until the book conforms to the expectations of the owner of the book.

It is to be understood that numerous additions, modifications, and substitutions may be made to the loosely bound book 10 of the present invention which fall within the intended broad scope of the appended claims. For example, the size, shape, and specific construction materials used may be modified or changed so long as the intended paper/foam/paper configuration of the pages 12 of the book is maintained. Furthermore, the size, length, and construction materials used in connection with the binding strap 30 and the exact nature of the binding strap closure device 40 may be modified or changed so long as the intended function of binding the pages 12 to one another in a releasable, replaceable, and changeable manner is maintained. Also, another method of use of the present invention would be to provide pre-printed pages 12 in four colors with various pictures that the child could reorder into the proper sequence upon the pages being scrambled, and it should be clear that numerous variations on this type of activity may be performed through use of the present invention. Finally, it should be noted that the colors and designs used in connection with the pages 12 of the present invention may be modified or changed to enhance the appearance of the loosely bound book 10 and also increase the book's appeal for potential purchasers.

There has therefore been shown and described a loosely bound book 10 having foam-based pages which accomplishes at least all of its intended objectives.

I claim:

1. A loosely bound book of foam-based pages comprising:

a plurality of pages, each page including a middle foam plate and front and back semi-rigid paper plates mounted on and sandwiching said middle foam plate;

said middle foam plate being larger than said front and back semi-rigid paper plates such that said middle foam plate extends beyond the edges of said front and back paper plates whereby the edges of each of said panels are foam;

at least one binder slot formed in each of said plurality of pages, said at least one binder slot extending through said middle foam plate and said front and back semi-rigid paper plates;

at least one binding strap extendable through said at least one binder slot of each of said plurality of pages for binding said plurality of pages in a book; and at least one releasable binding strap closure device mounted on said at least one binding strap, said at least one releasable binding strap closure device operative to open and close said at least one binding strap to add and remove pages from said loosely bound book.

2. The loosely bound book of foam-based pages of claim 1 wherein said at least one binder slot in each of said plurality of pages are formed in approximately the same location on each of said plurality of pages whereby said plurality of pages are generally aligned with one another when said at least one binder slots are in alignment.

3. The loosely bound book of foam-based pages of claim 1 wherein said at least one binder strap is constructed of a fabric material.

4. The loosely bound book of foam-based pages of claim 1 wherein said at least one binder strap is constructed of a plastic ring.

5. The loosely bound book of foam-based pages of claim 1 wherein said at least one releasable binding strap closure device comprises a hook and loop fastener having a hook section and a loop section, with said hook section mounted on one end of said at least one binding strap, and said loop section mounted on the opposite end of said at least one binding strap so that when said hook section is connected to said loop section, said one end and said opposite end of said at least one binding strap are releasably connected to one another, thus closing said at least one binding strap in a loop configuration.

6. The loosely bound book of foam-based pages of claim 1 wherein said front and back semi-rigid paper plates further comprise indicia printed thereon.

7. The loosely bound book of foam-based pages of claim 1 wherein said front and back semi-rigid paper plates are operative to accept markings produced by a writing implement and retain said markings thereon.

* * * * *